United States Patent [19]
Pehlke et al.
[11] 4,417,721
[45] Nov. 29, 1983

[54] LANCE TIP FOR OXYGEN STEELMAKING

[76] Inventors: Robert D. Pehlke, 9 Regent Dr., Ann Arbor, Mich. 48104; D. Roger Glass, 1575 Earhart Rd., Ann Arbor, Mich. 48105; Lyle J. Johnson, deceased, late of Grosse Ile, Mich.; by Evelyn Johnson, administratrix, East River Rd., Grosse Ile, Mich. 48138

[21] Appl. No.: 384,843

[22] Filed: Jun. 4, 1982

[51] Int. Cl.³ ..... C21C 5/32
[52] U.S. Cl. ..... 266/225; 266/270; 239/132.3
[58] Field of Search ..... 266/225, 270; 75/60; 239/125, 132, 132.3

[56] References Cited

U.S. PATENT DOCUMENTS 3,322,419 5/1967 Smith et al. ..... 239/132
3,337,203 8/1967 Smith et al. ..... 239/132

FOREIGN PATENT DOCUMENTS 1190137 4/1970 United Kingdom ..... 266/225
1255082 11/1971 United Kingdom ..... 266/225

*Primary Examiner*—L. Dewayne Rutledge
*Assistant Examiner*—Robert L. McDowell
*Attorney, Agent, or Firm*—Stephenson & Boller

[57] ABSTRACT

An oxygen lance has an improved coolant passage construction for cooling the distal end of the tip, said construction being characterized by coolant channels radiating from a central region and successively subdividing coolant flow flow in the radially outward direction.

15 Claims, 5 Drawing Figures

LANCE TIP FOR OXYGEN STEELMAKING

BACKGROUND AND SUMMARY OF THE INVENTION

This invention relates to lance tips for oxygen steelmaking and is particularly concerned with an improvement in cooling the distal end of a tip.

Numerous constructions for oxygen lance tips are known in the art. Examples of these lance tips are shown in the following U.S. Pat. Nos.: 2,979,270; 3,118,608; 3,170,016; 3,201,104; 3,302,882; 3,304,009; 3,309,195; 3,322,419; 3,337,203; 3,385,587; 3,427,151; 3,662,447; 3,752,402; 3,797,814; 3,052,005; 4,190,238; and 4,301,969.

An oxygen lance, particularly the lance tip, must be of extremely rugged construction due to the extreme conditions to which it is subjected when put to use by being exposed to the high temperatures and reactive materials within the interior of a steelmaking vessel. Out of necessity coolant passages through which coolant is conducted are provided for the lance tip so that the tip can survive its use in the high temperature metallurgical process.

It has been the practice in the art often to provide drilled holes in the tip head through which coolant is conducted. Examples of typical constructions are shown in many of the aforementioned patents. It is also known to provide a central inlet coolant passage extending through the tip head stopping short of the distal end face with generally radially extending passages intercepting the central passage adjacent the distal end face and conducting coolant radially from the central passage across the distal end of the tip to the outer perimeter of the tip where the coolant exits via a return passage back through the tip and the lance. The objective of this type of construction is to increase the cooling effect of the distal end of the tip where the conditions are particularly severe by maximizing the coolant flow across the end face of the tip. Because oxygen passages also extend through the tip to discharge oxygen at locations in the distal end of the tip, it is impossible for the radial coolant passages to cover the full extent of the distal end surface area. Because of structural considerations it is also necessary that certain wall thicknesses be provided between the radial coolant passages and the generally axially extending oxygen passages, and this reduces the amount of surface area which can be exposed to coolant. Furthermore, while it is desirable to place the radial passages as close to the distal end of the tip as possible, once again structural consideration can limit the proixmity, and this also reduces the cooling efficiency.

The coolant passages in prior tips possess the disadvantage of restricting the coolant flow without adequately utilizing the high coolant velocities thereby obtained. Inadequate control of coolant flow pattern and distribution of coolant flow have resulted in early deterioration of the lance tip.

Accordingly, with prior tip constructions, a point is eventually reached where the erosion or deformation of the tip mandates replacement of the tip. The cost of replacing a tip is substantial. Extension of the useful life of a tip can therefore improve the oxygen steelmaking process by contributing to a reduction in operating costs.

The present invention is directed to a new and improved oxygen lance tip with particular improvement being made to the cooling of the distal end face of the tip. With the improvement of the present invention the useful life of an oxygen lance tip can be significantly extended thereby contributing to reduction in operating costs at an oxygen steelmaking facility. A lance tip embodying principles of the invention provides coolant flow across the end face of the tip which is carefully controlled with regard to velocity and distribution. The tip is structurally very strong so as to resist and minimize the thermal and mechanical stresses.

The foregoing features, advantages and benefits of the invention along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF A PREFERRED EMBODIMENT

The current state of the art in oxygen steelmaking is such that most operating installations employ lances with three oxygen discharge nozzles. However, lances having one, two, four, or more nozzles have been used. Since the three-nozzle lance is most often employed at present, a preferred embodiment of the invention is described for this type of lance. However, the invention is not limited to this particular arrangement.

Figure 2:
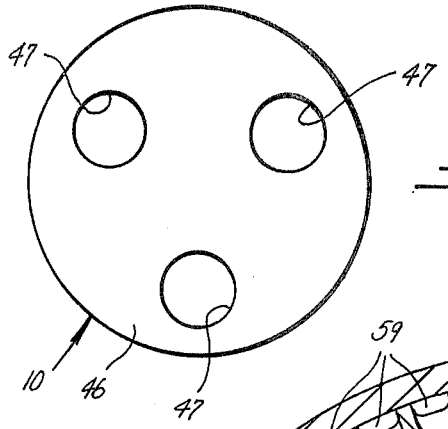
FIG. 2 is an enlarged axial end view of FIG. 1 at the tip end as taken in the direction of arrows 2—2 in FIG. 1.
Figure 1:
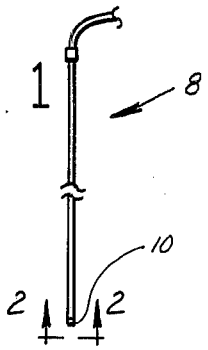
FIG. 1 is a diagrammatic view of an oxygen lance including the tip of the present invention.

FIG. 1 illustrates an oxygen lance 8 including the tip 10 of the present invention. The oxygen lance includes three concentric tubes 12, 14, and 16 (see FIG. 3) which cooperate to define a central oxygen inlet passage 18 having a circular cross section, a coolant inlet passage 20 of annular cross section which surrounds passage 18, and a coolant return passage 22 of annular cross section surrounding passage 20.

The tip further includes a head 24 in the form of a metal body constructed from a suitable metal and secured to the end of tubes 12 and 14, and positioned generally within the end of the outer tube 16 also. The tip head is provided with a passage 26 for conducting coolant such as water from the coolant inlet passage 20 to the distal end of the tip. This passage 26 may be considered as comprising segments **26*a* and 26*b*. There are three equally circumferentially spaced segments 26*a* each extending at an angle from the end of the coolant inlet passage 20 to the segment 26*b*. Segment 26*b* is concentric with the axis of the tip and extends to the distal end face of the tip head 24. A plurality of openings 30 are provided in the wall of segment 26*b* adjacent end face 28 for purposes of allowing coolant, after it has passed through passage 26, to be conducted radially over end face 28** in a manner which will be explained in greater detail later on.

The tip head 24 is also provided with one or more oxygen supply passages or nozzles 32. In the present embodiment these passages are three in number and are uniformly circumferentially arranged around the longitudinal axis of the assembly. The oxygen supply passages 32 are in communication with the oxygen inlet passage 18 and they diverge radially outwardly toward the distal end of the tip head with each terminating in a discharge opening 34 at the distal end face 28 of the tip head.

Figure 3:
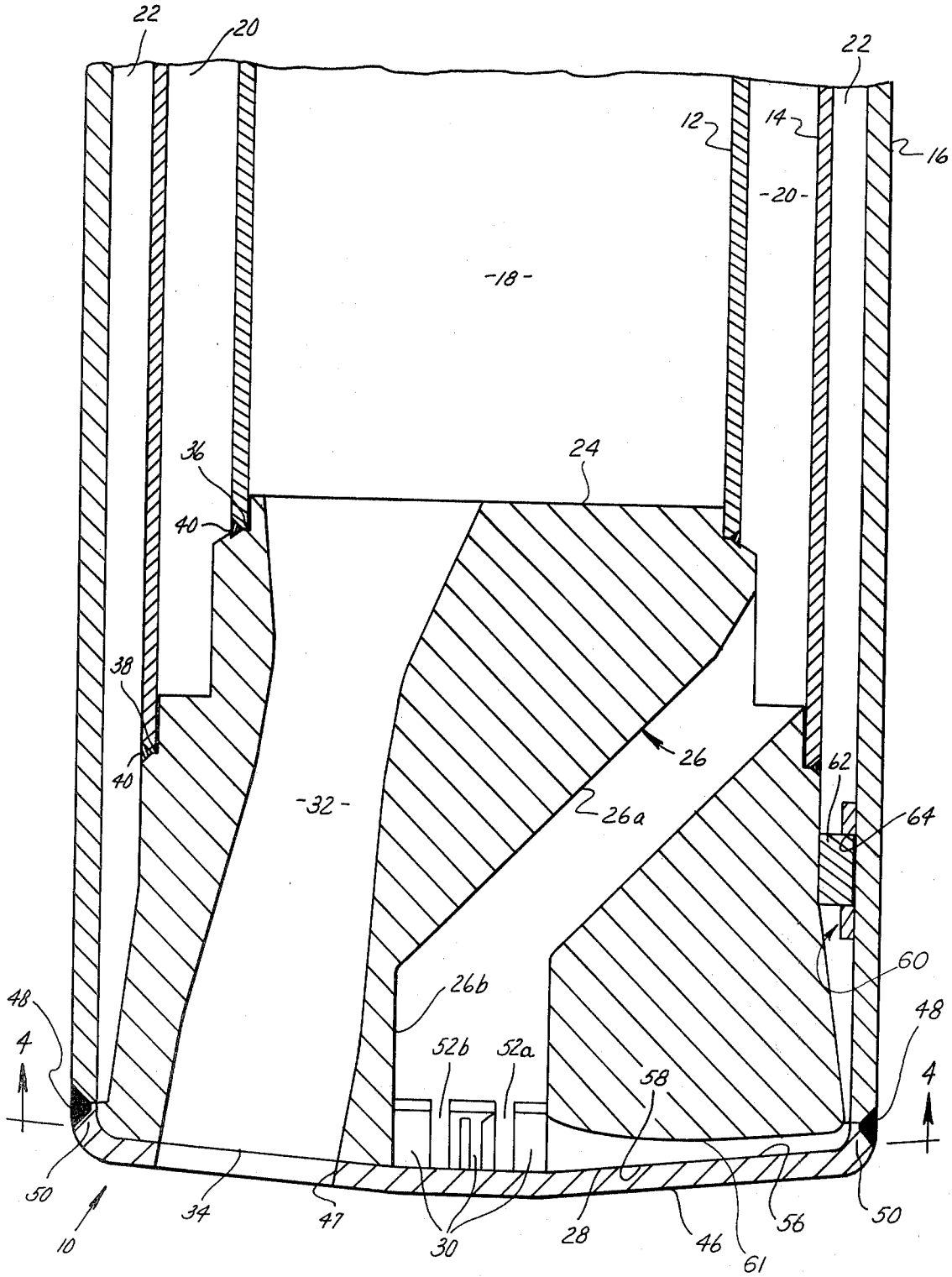
FIG. 3 is an enlarged longitudinal cross sectional view taken in the direction of arrows 3—3 in FIG. 4.

The shape of the oxygen nozzles 32 is chosen to produce high velocity oxygen jets and will generally be as shown in FIG. 3. From the top or entrance of nozzle 32 the cross sectional area of the nozzle first decreases to a minimum area or throat and then the area continuously increases to the cross section of the discharge opening 34. The expanding part of nozzle 32 is generally in the shape of a truncated cone with the greatest diameter occurring at the discharge opening 34. However, this maximum diameter may be reached before the discharge opening 34. In this case the lower part of nozzle 32 would be more or less in the shape of a truncated cone joined to a short cylinder, as depicted in FIG. 3. A cylinder discharge opening 34 might be of some advantage in the attachment of the face plate 46 to the tip head 24. However, the invention is not limited to either a constant area or a conically shaped discharge opening 34.

Tip head 24 is also formed with circular shoulders 36 and 38 which respectively fit to the ends of tubes 12 and 14 respectively. In accordance with conventional practices the tubes and the tip head are secured at the shoulders by conventional attachment procedures such as weldments 40. Preferably the material of tip head 24 is a strong yet highly thermally conductive material such as copper, a copper alloy or other material.

The tip also includes a cover, or face plate, 46 also preferably formed of copper, a copper alloy or other highly conductive material disposed over and secured to the distal end face 28 of tip head 24 and to the end of outer tube 16. The illustrated cover 46 is shown to include a short upturned flange, or lip, 50 which is secured to the end of outer tube 16 by a conventional attachment such as a weldment 48. Cover 46 also includes three circumferentially spaced apertures 47 registering with the oxygen outlets 34 so as to allow oxygen to be discharged from the lance tip.

The cover 46 may be shaped as depicted in FIG. 3 so that the axis of each oxygen nozzle 32 is perpendicular to its discharge opening 34. Alternatively, cover 46 may be essentially flat, except for the lip 50, so that the discharge opening 34 is not perpendicular to the axis of nozzle 32.

Cooling of the distal end of the tip is provided by a pattern of coolant channels which radiate from central passage segment **26*b* toward the outer perimeter of the distal end face of the tip head 24. The coolant channels are constructed and arranged such that the coolant flow is successively subdivided inthe direction from the central passage segment 26*b* to the outer perimeter of the distal end face 28. The coolant channels are cooperatively defined by the cover 46 and the distal end of the tip head 24**.

Figure 4:
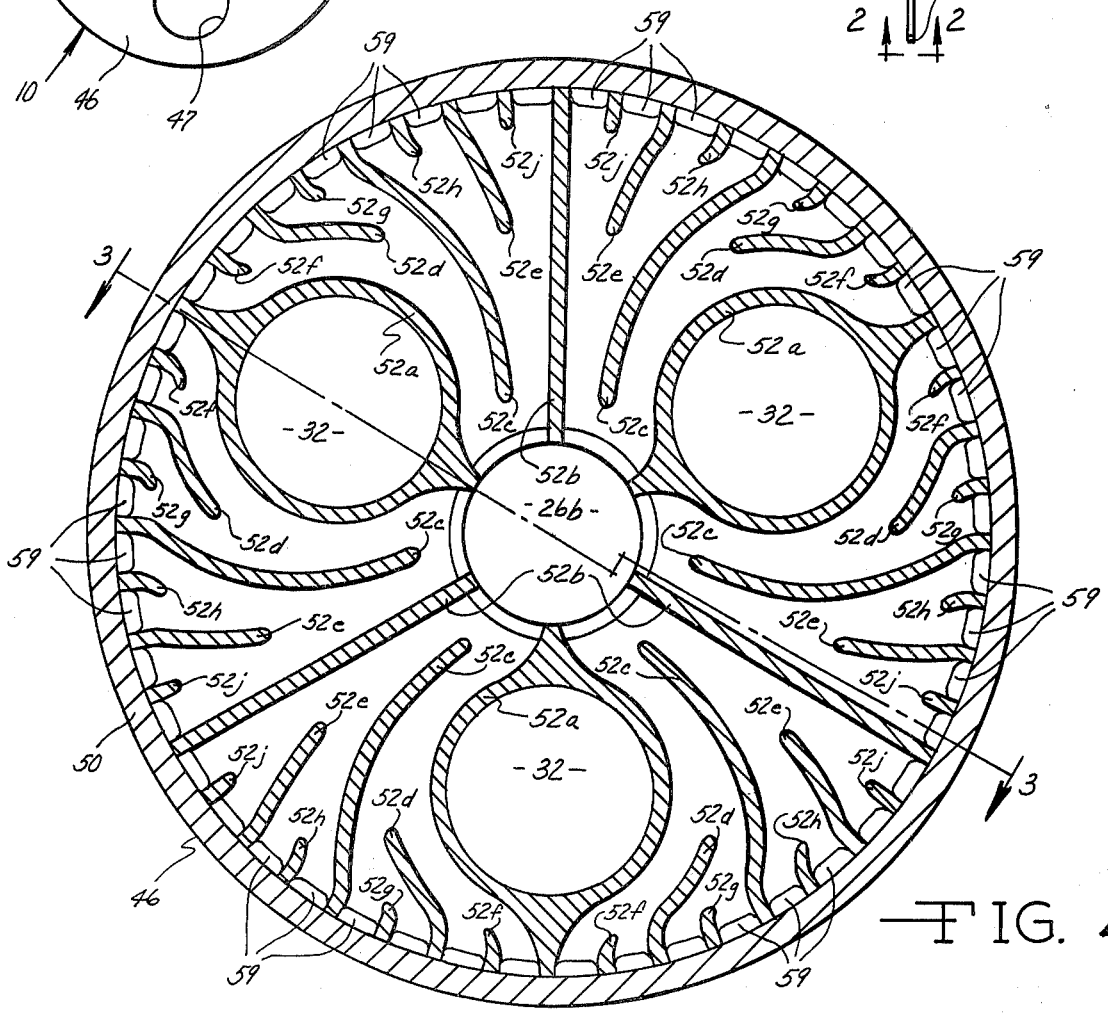
FIG. 4 is a transverse cross sectional view taken in the direction of arrows 4—4 in FIG. 3.
Figure 5:
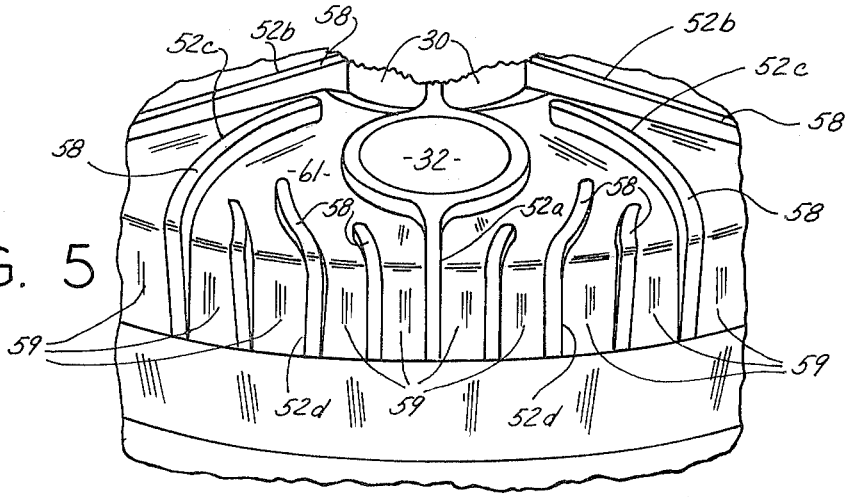
FIG. 5 is a fragmentary perspective view of a portion of FIG. 4.

The channels are provided by a pattern of ridges which are fashioned in the distal end of the tip head as best seen in FIGS. 4 and 5. For purposes of explanation all of the ridges will be designated by the base reference numeral 52 with particular literal suffixes identifying them.

Associated with each oxygen passage 32 is an oxygen passage partitioning ridge **52*a*. The oxygen passage partitioning ridges extend from the wall of passage segment 26*b* to the radially outer perimeter of the distal end of the tip head 24. As the partitioning ridges surround the oxygen passages, they are of a generally circular shape having elongations at the radially inner and outer ends as shown in FIGS. 4 and 5**.

Three separating ridges **52*b* are also provided. The separating ridges 52*b* are arranged 120° apart with each ridge 52*b* being circumferentially spaced midway between immediately adjacent ridges 52*a*. The separating ridges 52*b* also extend from the wall of passage segment 26*b* to the outer perimeter of the distal end of the tip head 24. Thus it may be perceived that this arrangement provides six openings 30 spaced around the wall of passage segment 26*b*, each opening 30 lying between one of the ridges 52*b* and one of the ridges 52*a***.

Each opening 30 constitutes the beginning of a coolant channel which radiates outwardly from the central region of the tip head, each channel being defined between a ridge **52*a* and a ridge 52*b*. As coolant passes through an opening 30 and enters a coolant channel, a point is reached where coolant flow is divided further by a ridge 52*c*. The ridge extends to the outer perimeter of the tip head and it has a curvature which is concave toward the corresponding ridge 52*a***.

As the divided coolant flow continues on, it may be even further divided by ridges **52*d* and 52*e*. The ridges 52*d* are disposed between the ridges 52*a* and 52*c* while the ridges 52*e* are disposed between ridges 52*b* and 52*c*. The ridges 52*d* have a certain slight concave curvature facing toward the corresponding ridge 52*a* but as they approach the outer perimeter of the tip head each ridge 52*d* bends into a short straight radial segment. The ridges 52*e* are also slightly concave toward the corresponding ridge 52*c*** and they also bend into a very short straight radial segment at the outer perimeter of the tip head.

Coolant flow may be even further divided before it reaches the outer perimeter of the tip head by means of additional ridges **52*f*, 52*g*, 52*h*, and 52*j***. These latter ridges are relatively short in length and are shaped as illustrated in the drawing figure.

As best seen in FIG. 3 the axial dimension (i.e. the height) of the ridges decreases in the radially outwardly direction. The decreasing height is imparted by the shape of the wall surface 61 of the tip head 24, and that of the inner wall surface 56 of the cover 46. The objective is to maintain a relatively uniform coolant velocity by reducing the gap between the wall surfaces 61 and 56 as the passages move toward the periphery of the lance tip. It will also be observed that at the outer perimeter of the tip head the ridges continue around the outer edge of the distal end face a short axial distance so as to provide for communication of the coolant channels with the coolant return passage 22. Thus all ridges terminate at the outer perimeter of the tip head, and coolant passes to return passage 22 via a multitude of openings 59 uniformly spaced around the perimeter of the tip head.

The cover 46 is disposed nominally perpendicular to the axis of the tip, and its inner surface 56 is disposed against the distal end face 28 of the tip head. The crests 58 of the ridges 52 are disposed against the surface 56 so as to preclude or minimize cross flow from one coolant channel to another coolant channel and between the subdivisions of the channels. Thus the coolant channels are separate coolant paths with coolant flow successively subdividing in the direction extending from passage segment 26b to the outer perimeter of the tip head where communication is established with the return passage 22. The contouring of the ridges, as perhaps best seen in FIG. 4, controls the distribution of the coolant flow across the end of the tip. Since the coolant flow is well controlled, the lance tip can be most effectively cooled. Because a substantial portion of the surface area of the cover 46 is exposed to coolant flow any tendency toward the occurrence of "hot spots" is alleviated. Because of the improved cooling efficiency, thermal stresses are also attentuated. As a consequence, the tip of the present invention experiences lower stresses and less erosion and deterioration thereby promoting increased longevity for the tip.

In constructing the illustrated tip, explosive forming and explosive bonding techniques may be used to advantage. Explosive bonding may be used to bond the cover 46 to the tip head by bonding the inner surface 56 to the crests 58 of the ridges. Because there will eventually be a certain amount of erosion of the end plate 46 over the course of use of the tip, a point will be reached where replacement becomes necessary. However, it is believed unnecessary to replace the entire tip; rather all that may be necessary is to replace the worn out cover 46 by a new cover.

Because the tip head 24 is constructed as a solid block of material, it possesses substantial strength. In order to assist in relieving stresses which might otherwise occur in the outer tube 16, it may be desirable to include an additional support between the tip head and the inner wall of tube 16 at a point spaced proximally from the distal end of the tip. In the illustrated embodiment this additional support structure is designated by the general reference numeral 60. It consists of a key and keyway arrangement having a key 62 on the tip head which fits within a keyway 64 which is fashioned on the inside wall of tube 16. One or more of the supports 60 may be provided at appropriate circumferential locations. The outer tube 16 is assembled onto the head by first positioning the outer tube such that the keyway 64 is circumferentially offset relative to the key 62, then bringing them into axial alignment and finally rotating the outer tube relative to the tip head so that the key 62 lodges in the keyway 64. The end plate 46 may then be attached, for example by welding, to tube 16 to complete the tip construction.

While a preferred embodiment of the invention has been disclosed in the drawings, it will be appreciated that principles of the invention may be applied to other embodiments. For example, the disclosed embodiment has the ridges 52 solely in the tip head 24. It would be possible to construct a tip according to principles of the invention by providing ridges in the cover 46 instead of in the tip head 24. The ridges in the cover would cooperate with the tip head in the same manner such that the coolant passages are thereby cooperatively defined. As a further example, some of the ridges might be fashioned in the tip head 24 and other of the ridges in the cover 46; once again these would be cooperatively arranged to define the coolant passages for the distal end face of the tip. Ridges 52a or 52b or 52a and 52b may be extended toward the central axis of the tip 24 into segment 26b of cooling passage 26. Fabrication procedures may involve explosive bonding, welding, or casting. Indeed it would be possible to cast the tip and cover as an integral unit, for example by the investment (lost wax) casting process.

The illustrated construction also is based upon the three symmetrically arranged oxygen passages 32. Principles of the invention may be applied to other configurations and different numbers of oxygen passages. The shapes and number of the individual ridges will have to be adjusted in accordance with such different configurations in order to achieve the best flow distribution characteristics. However they should still be patterned in an analogous manner to that which is disclosed herein. It should also be pointed out that the patent drawings are proportioned dimensionally to correspond to an example of an actual tip construction wherein the overall diameter at the distal end of the tip is approximately 12¾ inches in diameter. It should not be construed as imposing a limitation on the scope of the invention.

The invention thus provides a significant advance in the oxygen lance art.

It is claimed:

1. In an oxygen lance tip for steelmaking having an oxygen passage terminating in one or more oxygen outlets at the distal end face of the tip, and a coolant passage via which coolant is circulated through the tip, the improvement in said coolant passage for cooling the distal end face of the tip which comprises: means defining a plurality of coolant channels just interior of the distal end face, said channels being constructed and arranged to radiate from a central region of the tip toward the outer perimeter of the tip so that coolant flow across said distal end face radiates from said central region, said channels being axially bounded by said distal end face and by a wall surface spaced axially inwardly of said distal end face, and said channels being defined by a plurality of axial ridges extending between said wall surface and said distal end face and arranged and constructed to run generally radially and successively circumferentially subdivide the radiating coolant flow at least once after it has been axially confined by said wall surface and said distal end face as it radiates in the direction from the central region of the tip toward the outer perimeter of the tip.

2. The improvement set forth in claim 1 wherein said coolant channels are constructed and arranged such that coolant flow during its axial confinement by said wall surface and the distal end face of the tip is of a substantially uniform high velocity.

3. The improvement set forth in claim 1 wherein said plurality of axial ridges comprise an axial taper relating to said wall surface and said distal end face such that the radiating coolant flow during its axial confinement by said wall surface and the distal end face of the tip is of a substantially uniform high velocity.

4. The improvement set forth in claim 1 in which the lance tip comprises a tip head comprising a central axial passage via which coolant enters said central region of the tip, said tip head having a distal end face bounding said axial passage and constituting said wall surface, and wherein the lance tip further includes a cover disposed over the distal end face of said tip head, said tip head containing said axial ridges, and said cover and said tip head cooperatively defining said channels.

5. The improvement set forth in claim 4 in which the cover is nominally perpendicular to the axis of the lance tip and the axial dimension of each of said axial ridges progressively decreases toward the radially outer perimeter of the distal end face of the lance tip.

6. The improvement set forth in claim 1 in which said channels terminate at an outer space extending circumferentially around the outer perimeter of the lance tip on the interior of the distal end face.

7. The improvement set forth in claim 6 in which the lance tip comprises a plurality of oxygen outlets distributed circumferentially and spaced apart around the axis of the lance tip, certain ones of said axial ridges running the full distance between said channel region and said outer space, said certain ones of said axial ridges being arranged to partition each oxygen outlet from the others between said central region and said outer space such that each oxygen outlet is located circumferentially centrally of two of said certain ones of said axial ridges, and certain other ones of said axial ridges, each being associated with a corresponding one of said oxygen outlets and being located circumferentially between two of said certain ones of said axial ridges, each of said certain other ones of said axial ridges including a portion bounding the corresponding oxygen outlet, the initial flow into said channels from said central region being between each of said certain ones of said axial ridges and the immediately circumferentially adjacent ones of said certain other ones of said axial ridges.

8. The improvement set forth in claim 7 wherein certain further ones of said axial ridges are disposed to successively subdivide the initial flow into said channels and each of said certain further ones of said axial ridges is associated with a particular oxygen outlet, each of said certain further ones of said axial ridges having a radially inner end at a location which is radially disposed closer to the axis of the lance tip than is the corresponding oxygen outlet.

9. The improvement set forth in claim 8 wherein additional ones of said axial ridges are disposed in said channels and each of said additional ones of said axial ridges is associated with a particular oxygen outlet to impart still further subdivisions to the flow radially outwardly of the subdivisions created by said certain further ones of said axial ridges.

10. The improvement set forth in claim 9 in which the lance tip comprises a tip head having a distal end face containing said axial ridges formed integrally therewith and including a removable cover forming the distal end of the lance tip and replaceably secured onto the tip head, said cover containing a ridge-free interior surface which is disposed against said axial ridges.

11. The improvement set forth in claim 10 in which the cover is secured to said axial ridges by means of one of the following group: explosive bonding, welding, and casting.

12. The improvement set forth in claim 1 in which said wall surface terminates radially inwardly in an inner perimeter disposed closer to the axis of the lance tip than are the oxygen outlets.

13. In an oxygen lance tip for steelmaking having an oxygen passage terminating in one or more oxygen outlets at the distal end face of the tip, and a coolant passage via which coolant is circulated through the tip, the improvement in said coolant passage for cooling the distal end face of the tip which comprises: means defining a plurality of coolant channels just interior of the distal end face, said channels being constructed and arranged to extend radially between a central region of the tip and the outer perimeter of the tip, said channels being axially bounded by said distal end face and a wall surface spaced axially inwardly of said distal end face, and said channels being defined by a plurality of axial ridges extending between said wall surface and said distal end face and arranged and constructed to provide radially successive circumferential subdivisions between said wall surface and said distal end face in the direction from the central region of the tip toward the outer perimeter of the tip.

14. In an oxygen lance tip for steelmaking having an oxygen passage terminating in one or more oxygen outlets at the distal end face of the tip, and a coolant passage via which coolant is circulated through the tip, the improvement in said coolant passage for cooling the distal end face of the tip which comprises: means defining a plurality of coolant channels just interior of the distal end face, said channels being constructed and arranged to radiate between a central region of the tip and the outer perimeter of the tip, said channels being axially bounded by said distal end face and by a wall surface spaced axially inwardly of said distal end face, and said channels being defined by a plurality of axial ridges extending between said wall surface and said distal end face and arranged and constructed to run generally radially and provide at least one circumferential subdivision in the region of axial confinement of the coolant between said wall surface and said distal end face at a distance spaced radially outwardly of the point of radially innermost axial confinement of the coolant between said wall surface and said distal end face.

15. The improvement set forth in claim 14 wherein said coolant channels are constructed and arranged such that coolant flow during its axial confinement by said wall surface and the distal end face of the tip is of a substantially uniform high velocity.

* * * * *